US009518359B2

(12) United States Patent
Brauns et al.

(10) Patent No.: US 9,518,359 B2
(45) Date of Patent: Dec. 13, 2016

(54) DOCTOR BLADE HOLDER SYSTEMS

(71) Applicant: Kadant Inc., Westford, MA (US)

(72) Inventors: Allen Brauns, Sturbridge, MA (US); David Leeman, Worcester, MA (US); Robert Johnson, Sutton, MA (US)

(73) Assignee: Kadant, Inc., Westford, MA (US)

( * ) Notice: Subject to any disclaimer, the term of this patent is extended or adjusted under 35 U.S.C. 154(b) by 0 days.

(21) Appl. No.: 14/534,959

(22) Filed: Nov. 6, 2014

(65) Prior Publication Data

US 2015/0122444 A1 May 7, 2015

Related U.S. Application Data

(60) Provisional application No. 61/900,727, filed on Nov. 6, 2013.

(51) Int. Cl.
*D21G 3/04* (2006.01)
*D21G 3/00* (2006.01)

(52) U.S. Cl.
CPC ..... *D21G 3/04* (2013.01); *D21G 3/005* (2013.01)

(58) Field of Classification Search
CPC ..... D21G 3/005; D21G 3/00; D21G 3/04; B05C 11/041; B05C 1/0817; D21F 3/0281
USPC ..... 162/280–281; 118/413; 15/256.5, 256.51
See application file for complete search history.

(56) References Cited

U.S. PATENT DOCUMENTS 2,987,748 A * 6/1961 Baliol ..... 15/256.51
3,122,767 A * 3/1964 Carvill ..... 15/236.01
3,778,861 A * 12/1973 Goodnow ..... 15/256.51
4,141,112 A * 2/1979 Klemz ..... 15/256.51
4,367,120 A * 1/1983 Hendrikz ..... 162/281
4,789,432 A * 12/1988 Goodnow et al. ..... 162/281
5,066,364 A * 11/1991 Goodnow et al. ..... 162/281
5,230,775 A * 7/1993 Goodnow et al. ..... 162/281
(Continued)

FOREIGN PATENT DOCUMENTS

EP 0515747 B1 11/1997
WO WO 2009108754 A1 * 9/2009 ..... B05C 11/06

OTHER PUBLICATIONS

International Search Report and Written Opinion for related International Patent Application No. PCT/US2014/064373 issued on Feb. 12, 2015.

(Continued)

*Primary Examiner* — Jose Fortuna
(74) *Attorney, Agent, or Firm* — Gesmer Updegrove LLP

(57) ABSTRACT

The invention provides a doctor blade holder system that includes a doctor blade support structure, an adjustment profiling plate, and a series of adjustment mechanisms. The doctor blade support structure includes an elongated slot for receiving a doctor blade and a separate elongated slot to house mounting hardware. The adjustable profiling plate causes pressure to be applied to the working blade in a continuous manner along the length of the working blade, wherein the profiling plate is mounted to a holder mounting plate with a series of pairs of mounting structures allowing unconstrained flexure, or rotation, of the profiling plate with respect to holder mounting plate around two axes. The series of adjustment mechanisms attach to the holder mounting plate and acting on the profiling plate, wherein the adjustment mechanisms are capable of displacing the profiling plate in a bi-directional manner.

29 Claims, 10 Drawing Sheets

(56) References Cited

U.S. PATENT DOCUMENTS

| | | | | |
|---|---|---|---|---|
| 5,597,415 | A * | 1/1997 | Graf | 118/123 |
| 6,328,853 | B1 * | 12/2001 | Goodnow et al. | 162/281 |
| 6,942,734 | B2 * | 9/2005 | Rata et al. | 118/123 |
| 7,618,518 | B2 * | 11/2009 | Rata et al. | 162/280 |
| 7,713,384 | B2 | 5/2010 | Bartelmuss | |
| 8,152,966 | B2 * | 4/2012 | Eerikainen et al. | 162/281 |
| 8,337,666 | B2 * | 12/2012 | Johnson et al. | 162/199 |
| 8,974,638 | B2 * | 3/2015 | Knopp et al. | 162/280 |
| 2006/0180291 | A1 * | 8/2006 | Rata | 162/281 |
| 2006/0185812 | A1 * | 8/2006 | Rotherham | 162/280 |
| 2006/0225647 | A1 * | 10/2006 | Reid | 118/261 |
| 2008/0163997 | A1 * | 7/2008 | Loippo | 162/272 |
| 2010/0032112 | A1 * | 2/2010 | Eriksson | 162/111 |
| 2012/0132095 | A1 | 5/2012 | Melotti | |
| 2015/0075742 | A1 * | 3/2015 | Johnson et al. | 162/252 |
| 2015/0075928 | A1 * | 3/2015 | Johnson et al. | 188/266.1 |

OTHER PUBLICATIONS

International Preliminary Report on Patentability issued in related Int'l Patent App. No. PCT/US2014/064373 on May 19, 2016 (9 sheets).

* cited by examiner

DOCTOR BLADE HOLDER SYSTEMS

PRIORITY

This application claims priority from U.S. Provisional Application Ser. No. 61/900,727 filed Nov. 6, 2013, the entire content and substance of which is incorporated by reference herein in its entirety.

BACKGROUND

The present invention generally relates to doctor blade holders and relates in particular to doctor blade holders that may be used with roll surfaces wherein the roll surface is not uniform.

For example, certain types of rolls, such as Yankee rolls used for making tissue paper, may have very large diameters that are not uniform along the longitudinal direction of the roll. Certain such rolls, for example, may have a diameter at the center of the roll that is greater than the diameter(s) at the ends of the roll. This may be by design to facilitate the transfer of an intermediate tissue product onto the roll, but presents difficulties in trying to provide a doctor blade that matches the surface of the roll.

Conventionally, adjustments of the position of a doctor blade along the length of a roll have been achieved by providing adjustment screws at spaced apart locations (e.g., every few inches) along the length of the doctor blade holder that urge the doctor blade closer to the roll surface. Unfortunately, however, such adjustments may compromise other portions of the doctor blade holder, such as locations where the doctor blade holder is attached to a holder mounting plate or doctor back, and may further introduce inconsistencies in the pressure applied by the doctor blade onto the roll surface.

There remains a need therefore, for a doctor blade holder that efficiently and effectively permits small localized adjustments of the position of a doctor blade without the above attendant drawbacks.

SUMMARY

In accordance with an embodiment, the invention provides a doctor blade holder system that includes a doctor blade support structure, an adjustment profiling plate, and a series of adjustment mechanisms. The doctor blade support structure includes an elongated slot for receiving a doctor blade and a separate elongated slot to house mounting hardware. The adjustable profiling plate causes pressure to be applied to the working blade in a continuous manner along the length of the working blade, wherein the profiling plate is mounted to a holder mounting plate with a series of mounting structures allowing unconstrained flexure, or rotation, of the profiling plate with respect to holder mounting plate around one or two axes. The series of adjustment mechanisms attach to the holder mounting plate and acting on the profiling plate, wherein the adjustment mechanisms are capable of displacing the profiling plate in a bi-directional manner.

In accordance with another embodiment, the invention provides a doctor blade holder system that includes a doctor blade support structure, a plurality of adjustment mechanisms, and a plurality of movable attachment mechanisms. The doctor blade support structure includes an elongated slot for receiving a doctor blade and a separate elongated slot to house mounting hardware for attaching the doctor blade support structure to a holder mounting plate. The plurality of adjustment mechanisms attach to the holder mounting plate and acting on a profiling plate, wherein the adjustment mechanisms are capable of displacing the profiling plate relative to the holder mounting plate. The plurality of movable attachment mechanisms are for attaching the doctor blade support structure to the holder mounting plate yet permit the profiling plate to move with respect to the holder mounting plate

BRIEF DESCRIPTION OF THE DRAWINGS

The following description may be further understood with reference to the accompanying drawings in which.

Figure 1:
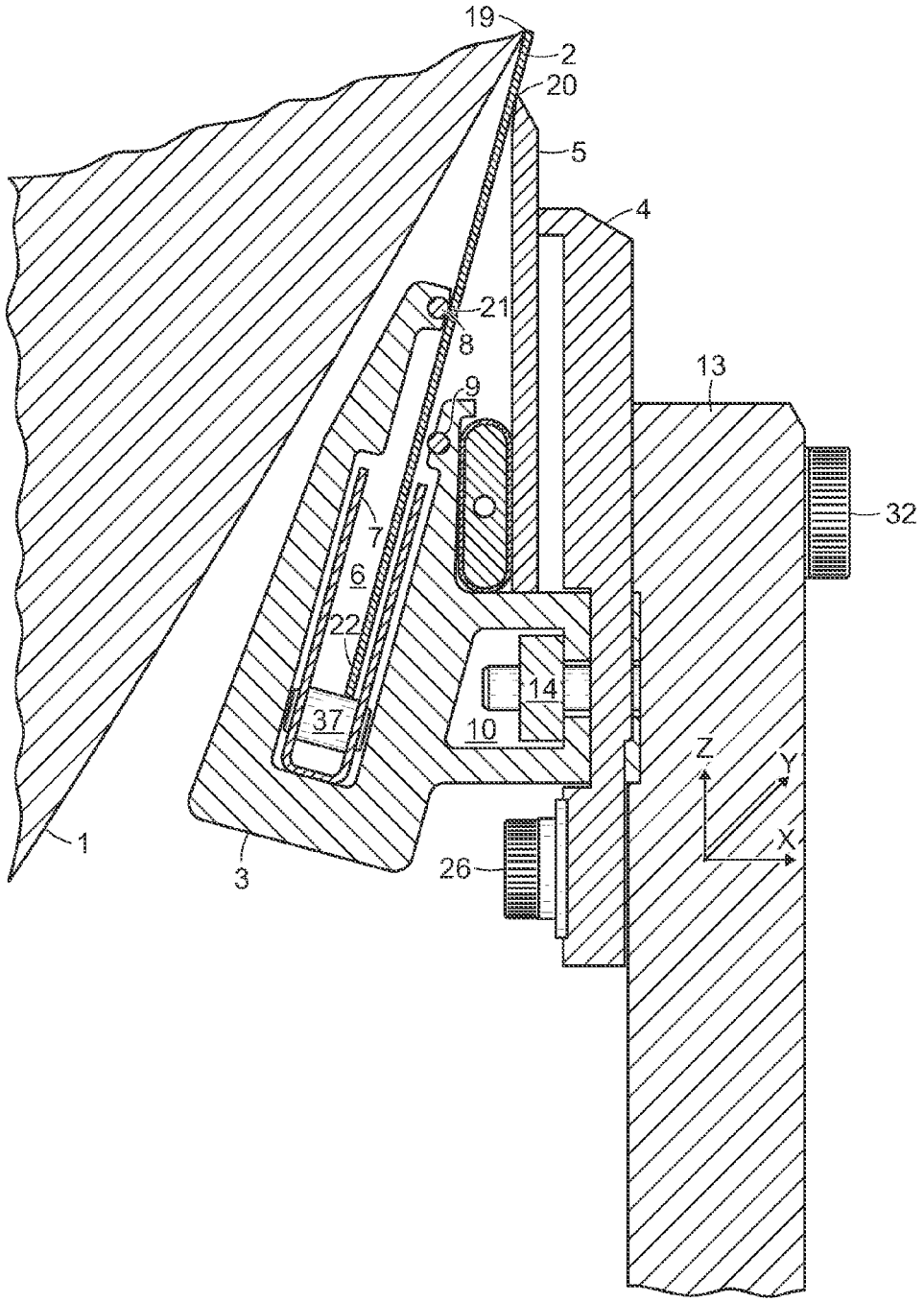
FIG. 1 shows an illustrative diagrammatic view of a doctor blade holder system in accordance with an embodiment of the present invention.

The drawings are shown for illustrative purposes only.

DETAILED DESCRIPTION

The present invention provides an improved doctor blade holder that may be used for creping tissue off of a dryer roll in a tissue making machine (e.g., a Yankee dryer). Doctor blade holders of the invention provide precise adjustment features allowing the creping blade to be loaded more uniformly against the Yankee surface. Further, embodiments of the invention will help to preserve the Yankee surface by minimizing blade chatter and vibration. In addition to tissue manufacturing applications, doctor blade holders of the invention may be used in many other manufacturing processes where a product or contaminants need to be removed or scraped off of the surface of a rotating roll, belt or other moving surface.

Referring to FIGS. 1-5, in accordance with an embodiment, the present invention provides an improved doctor blade holder assembly that includes a doctor blade support structure 3, a profiling plate 4 and a back-up blade 5. The doctor blade support structure 3 retains a doctor blade 2, in close proximity to the generally cylindrical surface of a Yankee dryer 1. The doctor blade support structure 3, includes a doctor blade receiving groove 6, which is preferably fitted with a doctor blade cartridge 7. The doctor blade cartridge 7, includes multiple internal spacer elements 37 that are attached to both side walls of the cartridge and provide support to the bottom edge of the doctor blade. The top edge of the doctor blade, the working edge, is pressed against the Yankee surface 1. The back-up blade may have a thickness of about 0.025 inch to about 0.250 inch.

The doctor blade support structure 3 includes two integrated wear bars. The first wear bar 8 is secured in the wall of the doctor blade support structure 3 closest to the Yankee surface, while the second wear bar 9 is secured in the wall of the blade support structure 3 furthest from the Yankee surface 1. The wear bars 8 and 9 provide contact points for the blade while it is in operation, and also during insertion and removal of the blade 2 from the doctor blade support structure 3.

The doctor blade support structure 3 also includes a T-shaped longitudinal slot 10 that spans the full length of the structure. This T-shaped slot 10 is used for mounting purposes. A series of milled out recesses 11 (shown in FIG. 3) are spaced along the length of the member. The remaining lands 12 between the recesses, mate against the holder mounting plate 13 to provide a stable mounting for the blade support structure 3.

Additionally, a clamping bar 14 is contained within the T-slot 10. The clamping bar 14 may be formed of a continuous length, or may be configured as a series of segmented bars. The clamping bar 14 has a series of holes spaced in the longitudinal direction. The holder mounting plate 13 has a series of tapped holes 15 that are spaced in alignment with the tapped holes in the clamping bar 14. The holder mounting plate 13 also has a series of tapped holes 40 for receiving shoulder screws 26 (as discussed in more detail below) as well as a series of clearance holes 42, 44 for receiving an adjustment mechanism 29 (as also discussed in more detail below).

The cap screws 16 pass through holes 47 in the profiling plate 4 are used to force the clamping bar 14 against an inner surface of the T-slot 17, which in turn forces the blade support structure 3, firmly against the holder mounting plate 13 of the doctor beam. Preferably, a shallow groove 18, corresponding to the width and location of the lands 12 is machined in the holder mounting plate 13 to ensure that the blade support structure 3 will remain straight and fixed in the proper location. The doctor blade support structure 3 may also be formed of one continuous member or may be segmented in order to reduce manufacturing costs. If it is segmented, then an additional load-bridging member may be utilized. This load-bridging member would provide a connection between segments and would serve to align the facing ends of adjacent segments.

When the blade 2 is loaded against the Yankee surface 1 there are four contact forces or contact lines of force acting on it. The first, is the contact line 19, between the working edge of the blade and the Yankee surface; the second, is the contact line 20 between the back-up blade 5 and the outer surface of the working blade; the third, is the contact line 21 between the wear bar 8 closest to the Yankee surface and the inner surface of the working blade; and the fourth is the contact force 22 between the base of the cartridge and the bottom edge of the blade. Preferably, the doctor blade support structure is an aluminum extrusion. However, it could also be a fiber reinforced plastic (composite material) pultruded or laid up to obtain the correct geometry, or may be an assembly of metallic components.

The profiling plate 4 extends in the longitudinal direction and is attached along the bottom edge thereof to the holder mounting plate 13 with spherical type mounting arrangements 23. Adjustment mechanisms 29 are provided along the longitudinal direction of the profiling plate 4 and the holder mounting plate 13 that permit the profiling plate 4 to be moved a small amount away from the holder mounting plate 13 in order to accommodate small variations in the distance between the tip of the doctor blade 2 and the roll surface 1. This is shown in more detail in FIG. 5, which shows the holder in cross-section with the profiling plate adjusted towards the Yankee. For example and as discussed above, certain Yankee doctor rolls may have diameters at the ends of the roll that are smaller than the diameter at the center of the roll (e.g., be barrel-shaped). In this case, the adjustment mechanisms 29 provide that the blade may be pushed toward the roll surface at the ends to match the shape of the roll surface.

Figure 2:
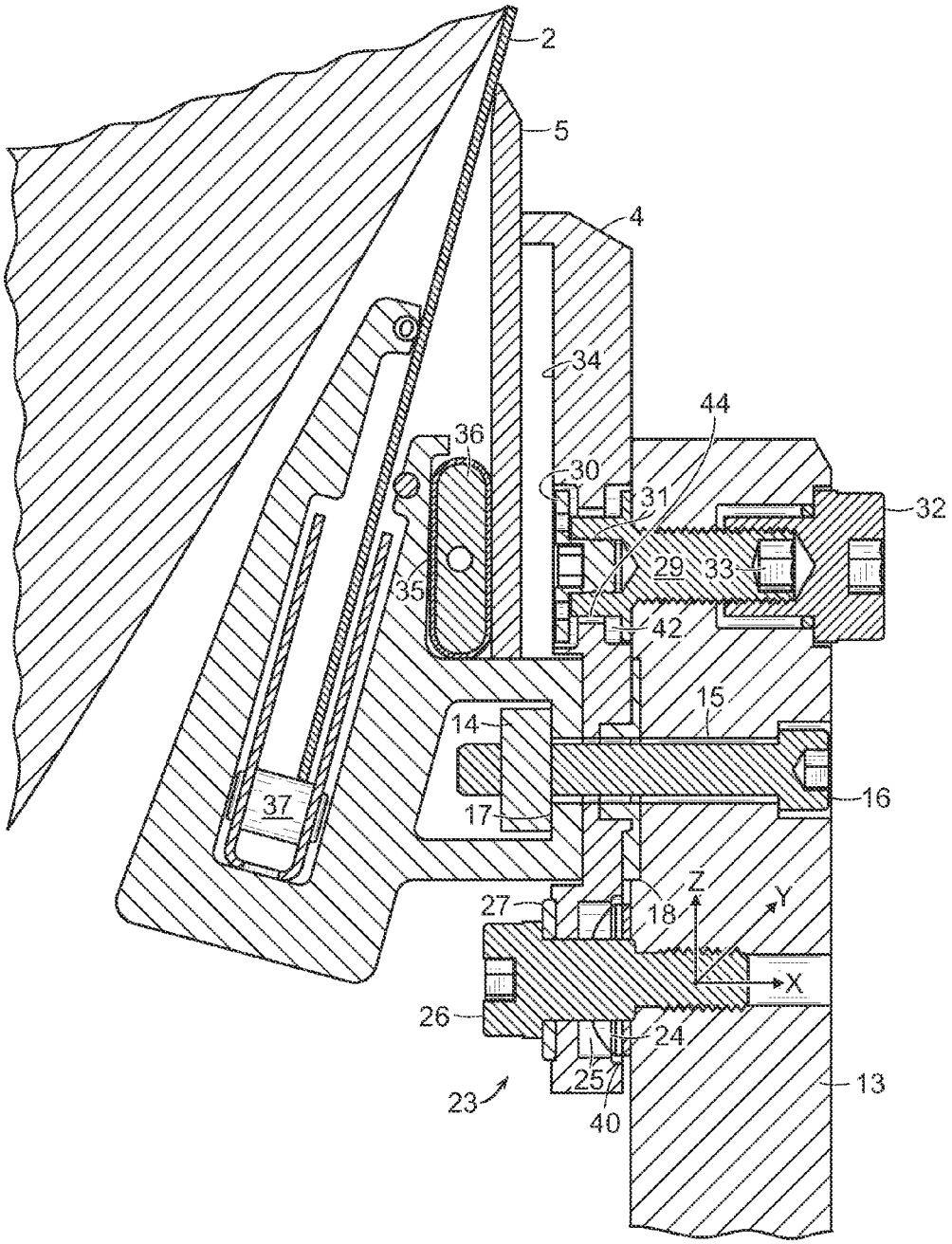
FIG. 2 shows an illustrative diagrammatic sectional view of the doctor blade holder system of FIG. 1.
Figure 3:
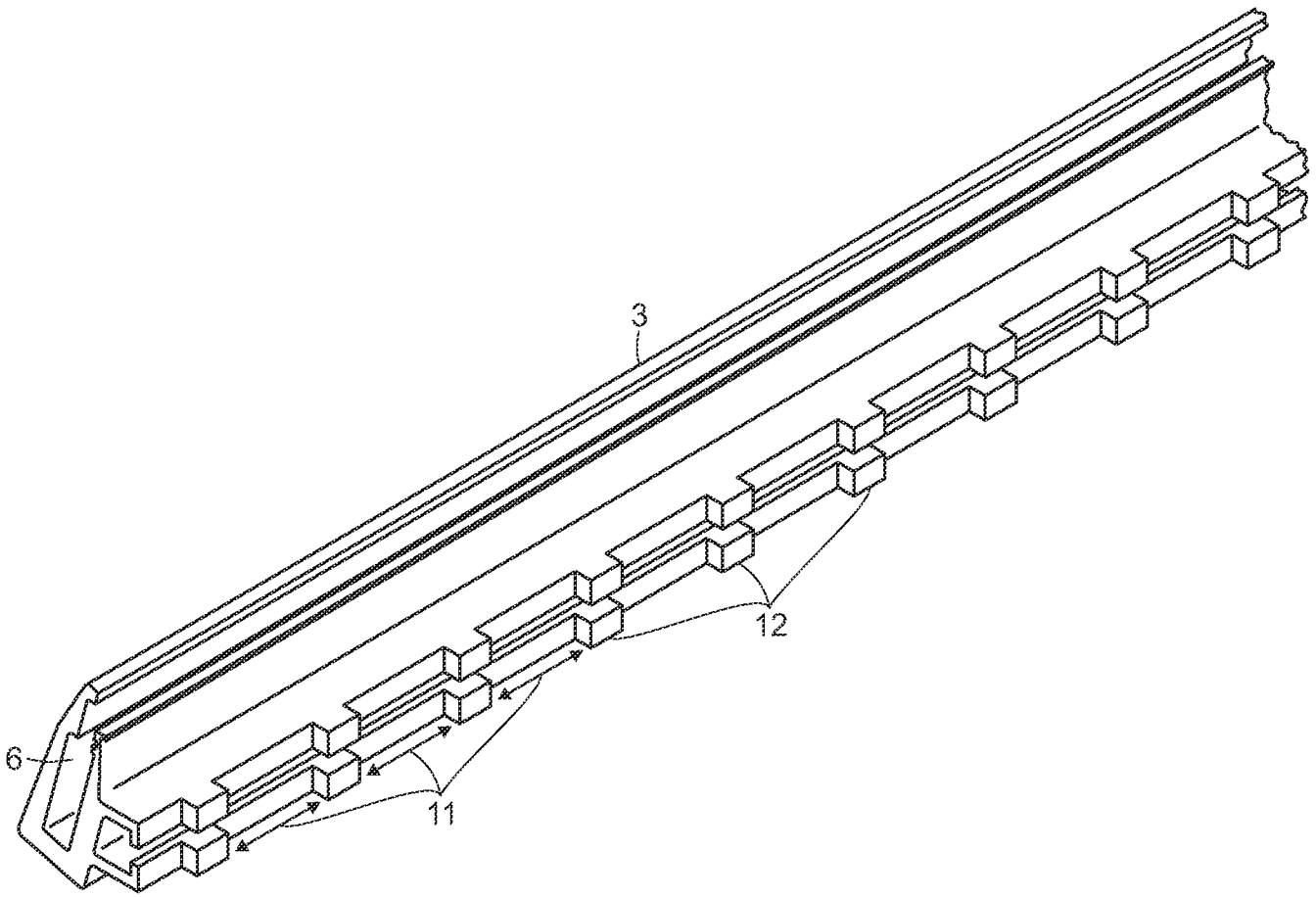
FIG. 3 shows an illustrative diagrammatic isometric view of the doctor blade support structure of the doctor blade holder system of FIG. 1.
Figure 4:
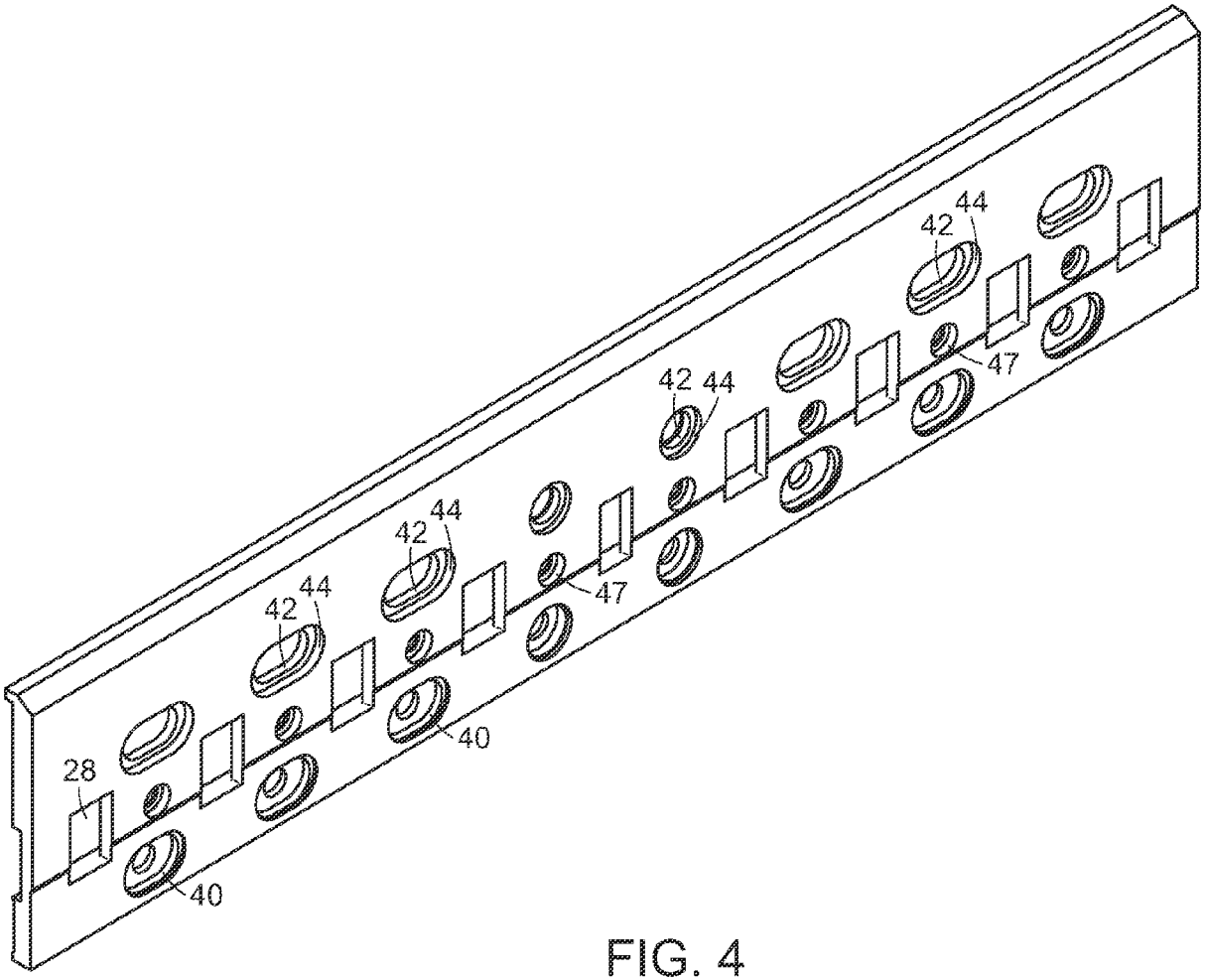
FIG. 4 shows an illustrative diagrammatic isometric view of the profiling plate of the doctor blade holder system of FIG. 1.
Figure 5:
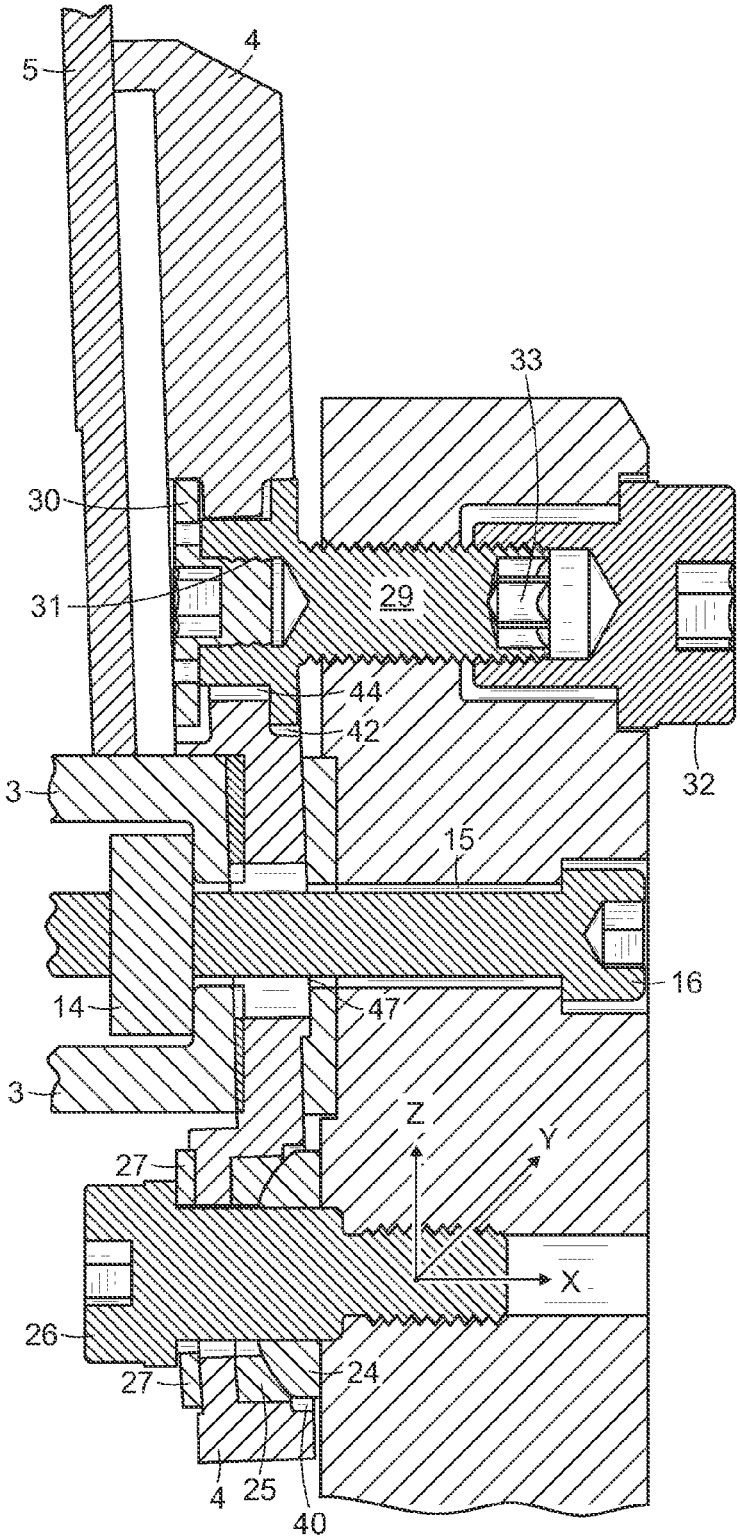
FIG. 5 shows a partial illustrative diagrammatic sectional view of the doctor blade holder of FIG. 1 wherein actuation of an adjustment mechanism has caused relative movement of a profiling plate mounting structure with respect to a holder mounting plate mounting structure.

The spherical mounting arrangements 23 allow for flexure, or localized rotation, of the profiling plate around one or two axes shown diagrammatically in FIG. 2. In accordance with an embodiment, the spherical mounting arrangement 23 may include a spherical thrust bearing having mounting structure elements 24 and 25, that cooperate to with a shoulder screw 26 and a cupped washer 27 (e.g., a Bellville type spring washer) to provide a small range of movement of the profiling plate 4 with respect to the holder mounting plate 13 responsive to movement of the adjustment mechanism 29. In particular, as the adjustment mechanism urges the profiling plate 4 toward the roll surface, the cupped washer and the profiling plate mounting structure 25 moves with the profiling plate, while the holder mounting plate mounting structure 24 remains with the holder mounting plate 13.

In particular and again with reference to FIG. 5, during adjustment of the adjustment mechanism 29, the shoulder screw 26 and the convex portion 24 of the assembly remain fixed, while the cupped washer 27 and the concave portion 25 of the assembly move with the profiling plate to accommodate the pivoting motion of the profiling plate 4 caused by the movement of the profiling plate 4 with respect to the holder mounting plate 13 (which, again was caused by adjustment of the adjustment mechanism 29). In accordance with further embodiments of the invention, many other spherical mounting designs may be used to provide the required freedom of movement of the profiling plate 4 with respect to the holder mounting plate 13.

A series of spaced, rectangular-shaped, openings 28 are machined in the profiling plate allowing the lands of the doctor blade support structure 12 to pass through, and mate up to the holder mounting plate. The profiling plate 4 may be one continuous member or it may be segmented in order to increase flexibility or reduce manufacturing costs. If it is segmented, then an additional load-bridging member would be utilized. This load-bridging member would provide a connection between segments and would serve to align the facing ends of adjacent segments. A series of adjustment mechanisms 29 are threaded through the holder mounting plate 13 and act on the upper area of the profiling plate 4.

One embodiment of these adjustment mechanisms 29 consists of a rotatable, externally threaded body and a flanged connection to the profiling plate. A preferred design has an inner removable flange 30 that is attached to the main body of the adjustment mechanism 29 with a left-hand threaded connection 31. By machining this connection with left-hand threads, the forces applied to the flange will serve to tighten the flange rather than loosen it when adjustments are made. These adjustment mechanisms 29 may be set independently, within a range, to force the upper edge of the profiling plate 4, into or away from the back-up blade 5. The back-up blade 5, in turn, transfers this movement, and associated force, directly into the working blade 2. This feature allows precise control of the contact load 19 between the working blade and the Yankee surface, continuously across the full width of the Yankee. Again, this is important because the typical Yankee surface is not straight but is crowned in a barrel-shaped manner where the radius at the center of the Yankee is slightly larger than at its edges (typically 0.025 to 0.125 inch).

Once each adjustment mechanism, item 29, is set, a special cap, item 32, with female threads is screwed onto the adjustment mechanism 29 and tightened. This action serves to lock the adjustment mechanism 29 at the desired setting, while also preventing process contaminants from interfering with the threads or filling the wrench socket 33.

The inner surface 34 of the profiling plate 4 in conjunction with an outer surface 35 of the blade support member 3 combine to create a cavity for the back-up blade 5 and the blade pressure equalizing tube 36. This equalizing tube 36, applies an even pressure along the bottom of the back-up blade. This effect is transferred to the contact interface 20 between the back-up blade and the working blade, helping to ensure that the working blade is loaded evenly against the Yankee surface. Preferably, the equalizing tube 36 is filled with a viscous liquid; however, it could be a solid material (for example an elastomer) for high-load or high-temperature applications.

Figure 6:
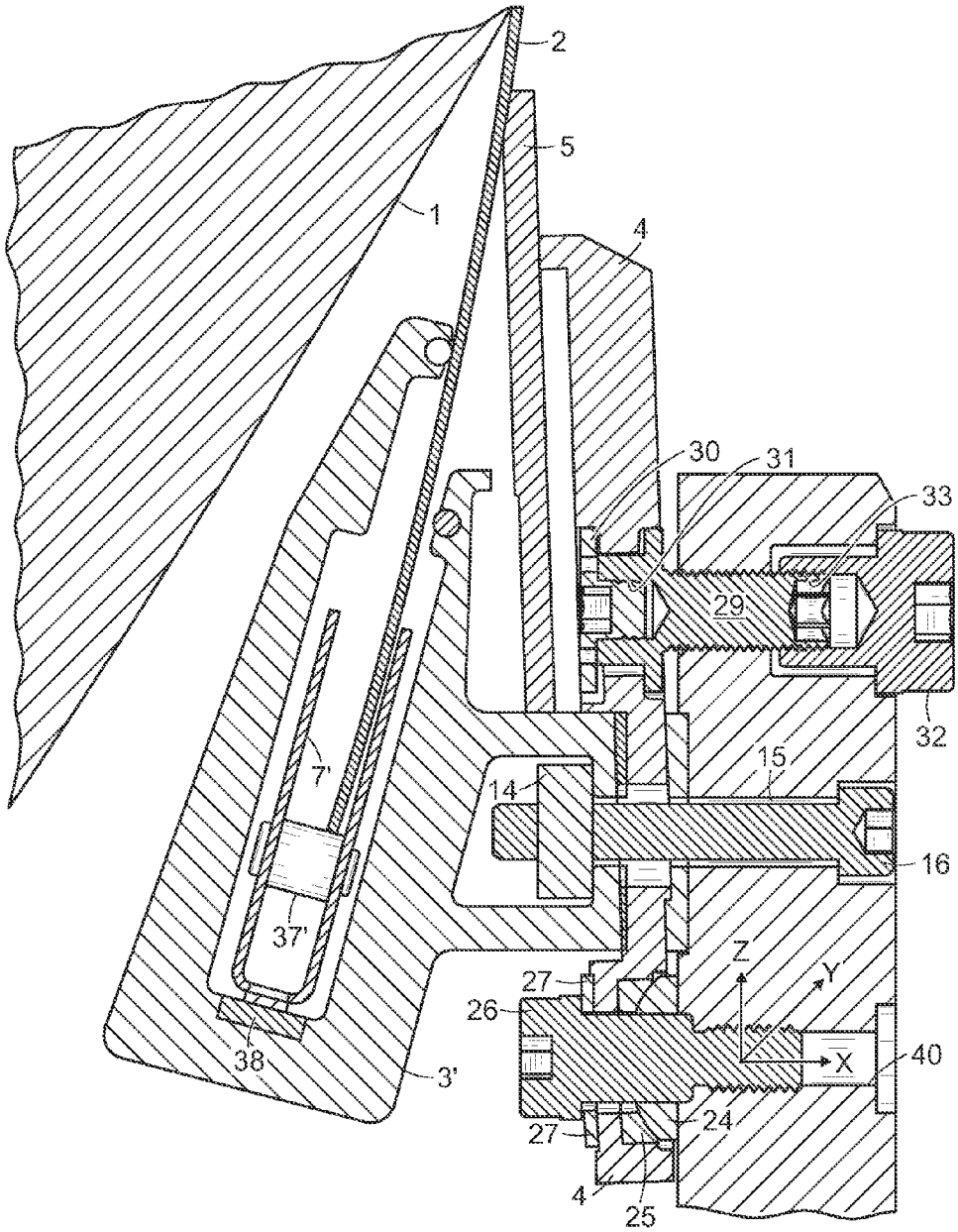
FIG. 6 shows an illustrative diagrammatic view of a doctor blade holder system in accordance with another embodiment of the present invention that includes at least one load sensor in the doctor blade cartridge.
Figure 7:
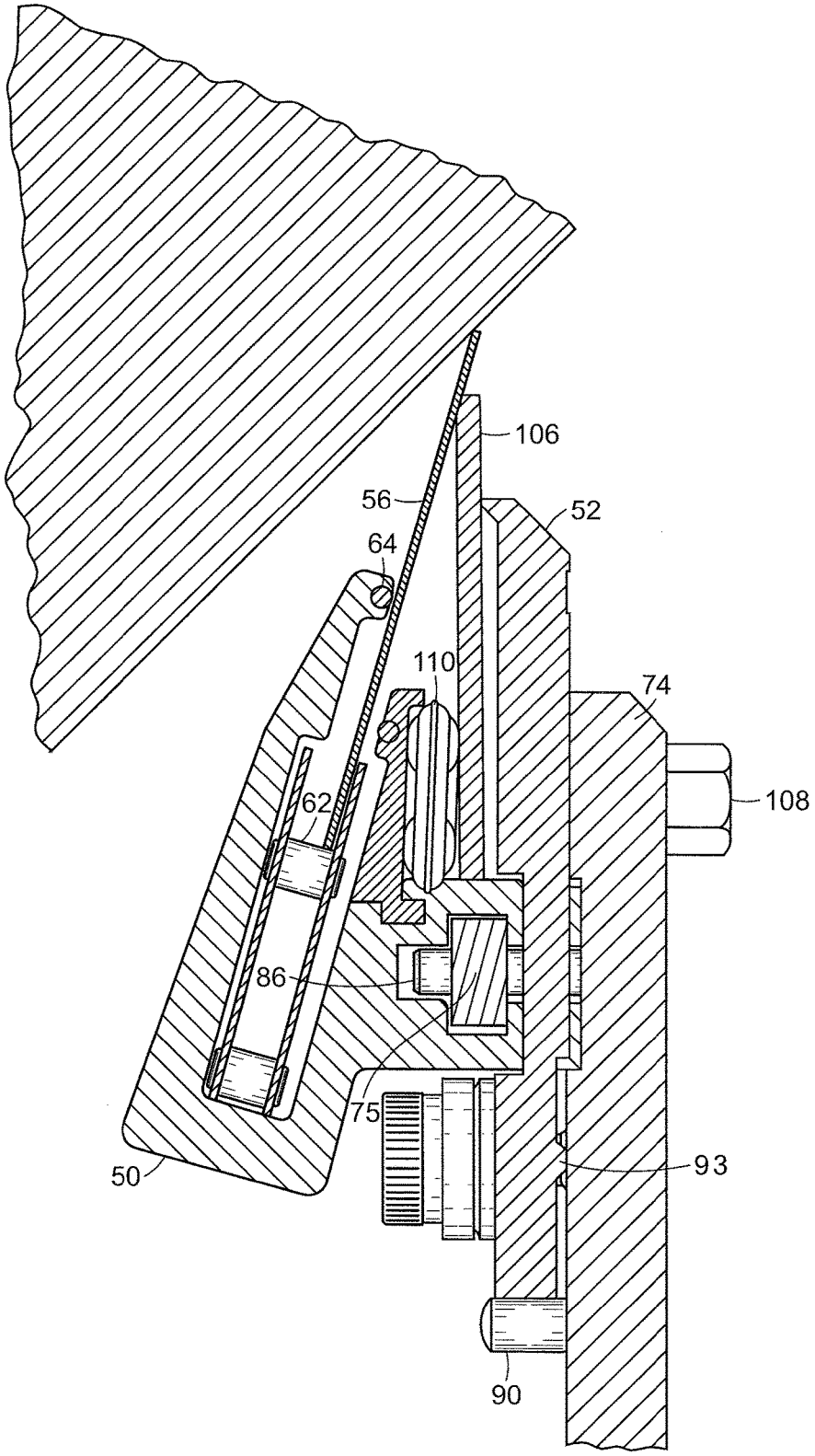
FIG. 7 shows an illustrative diagrammatic view of a doctor blade holder system in accordance with a further embodiment of the present invention involving different adjustment mechanisms and different spherical type mounting arrangements.
Figure 8:
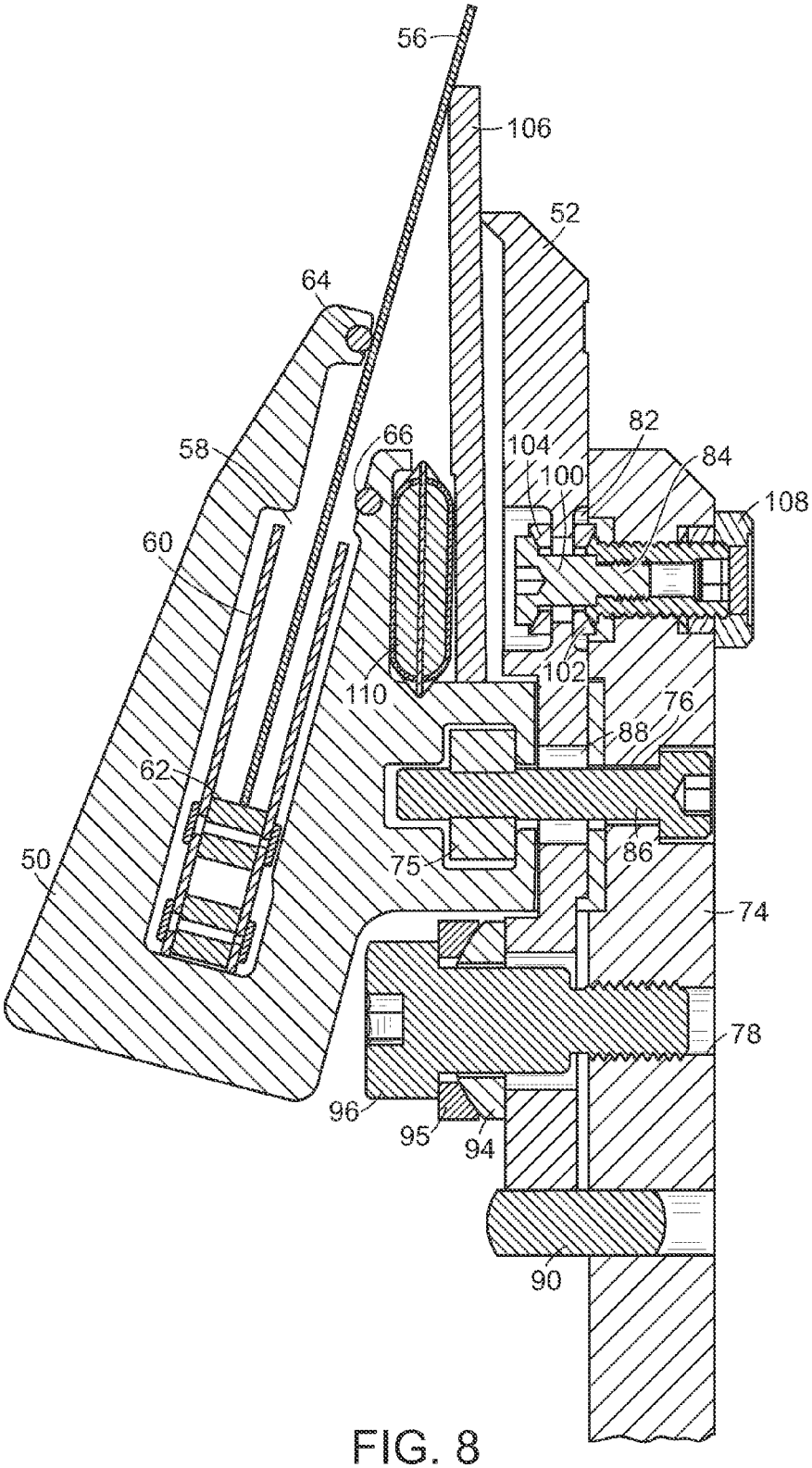
FIG. 8 shows an illustrative diagrammatic sectional view of a doctor blade holder system in accordance with a further embodiment of the present invention involving different adjustment mechanisms and different spherical type mounting arrangements.
Figure 9:
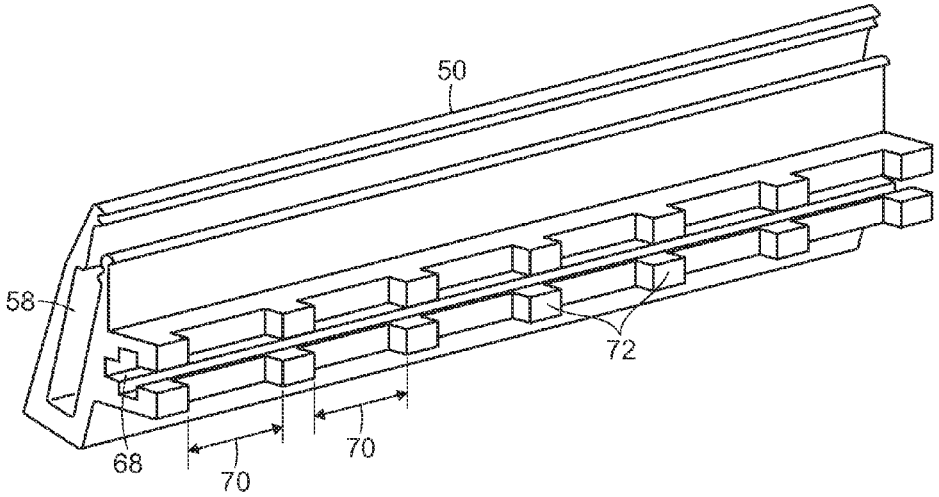
FIG. 9 shows an illustrative diagrammatic isometric view of the profiling plate of the doctor blade holder system of FIG. 7.

If desired, the internal spacer elements 37' may be equipped with load or vibration sensors, such as strain gages, to measure the force transmitted through the axis of the doctor blade 2 (as shown in FIG. 6). The tissue manufacturing operation will find value in monitoring this force as it is closely related to the frictional force, or tangential force, between the working edge of the doctor blade 2 and the Yankee surface 1. In other words, this force is what is required to remove the tissue sheet from the Yankee. FIG. 8 for example, shows the use of load or vibration sensors 38 that are embedded in the base of the doctor blade support structure 3 (beneath the doctor blade cartridge 7') in order to sense the tangential force transmitted through the doctor blade.

The remaining components of the doctor blade holder system of FIG. 6 are the same as those of the embodiment of FIGS. 1-5 and bear the same reference numerals. As with the system shown in FIG. 5, the profiling plate 4 of FIG. 6 is shown displaced from the holder mounting plate 13 by actuation of an adjustment mechanism 29, wherein both the cupped washer 27 and the profiling plate mounting structure 25 move with the profiling plate, and the holder mounting plate mounting structure 24 remains with the holder mounting plate 13.

Referring to FIGS. 7-11, in accordance with a further embodiment, the present invention provides an improved doctor blade holder assembly that again includes a doctor blade support structure 50, a profiling plate 52 and a back-up blade 106. The doctor blade support structure 50 retains a doctor blade 56, in close proximity to the generally cylindrical surface of a Yankee dryer. The doctor blade support structure 50, includes a doctor blade receiving groove 58, preferably fitted with a doctor blade cartridge 60. The doctor blade cartridge 60, includes multiple internal spacer elements 62 that are attached to both side walls of the cartridge and provide support to the bottom edge of the doctor blade. The top edge of the doctor blade, the working edge, is pressed against the Yankee surface 1. The back-up blade may have a thickness as discussed above. The doctor blade support structure 50 includes two integrated wear bars similar to the wear bars 64, 66 discussed above with reference to the embodiment of FIGS. 1-5.

The doctor blade support structure 50 also includes a T-shaped longitudinal slot 68 that spans the full length of the structure. This T-shaped slot 10 is used for mounting purposes. A series of milled out recesses 70 (shown in FIG. 9) are spaced along the length of the member. The remaining lands 72 between the recesses, mate against the holder mounting plate 74 to provide a stable mounting for the blade support structure 50.

Figure 10:
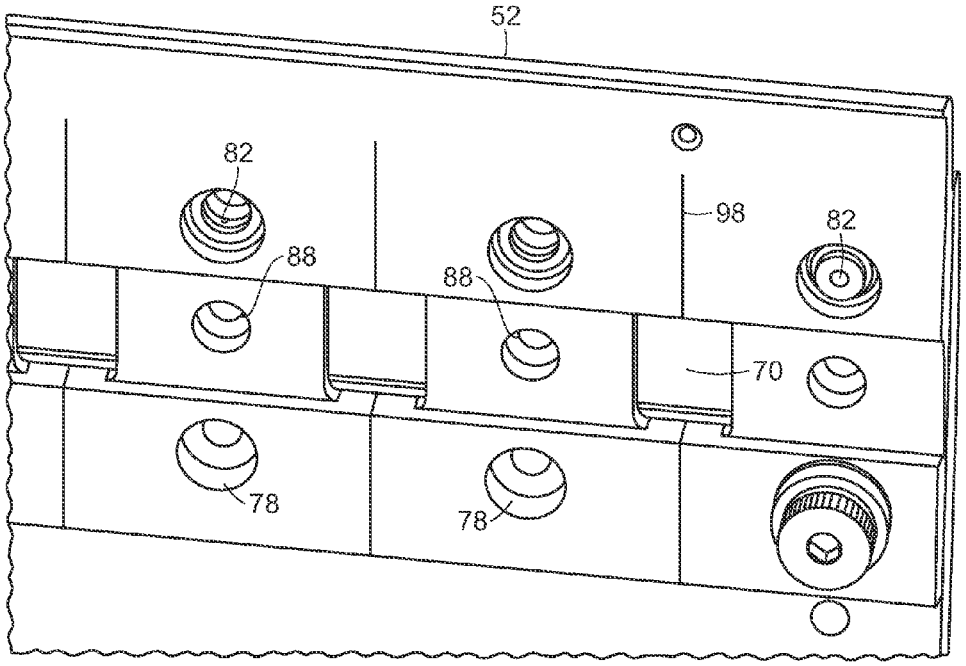
FIG. 10 shows a partial illustrative diagrammatic sectional view of the doctor blade holder of FIG. 7 wherein actuation of an adjustment mechanism has caused relative movement of a profiling plate mounting structure with respect to a holder mounting plate mounting structure.

A clamping bar 75 is contained within the T-slot 68. Again, the clamping bar 75 may be formed of a continuous length, or may be configured as a series of segmented bars. The clamping bar 75 has a series of holes spaced in the longitudinal direction. The holder mounting plate 74 has a series of tapped holes 76 that are spaced in alignment with the tapped holes in the clamping bar 75. The holder mounting plate 74 also has a series of tapped holes 78 for receiving shoulder screws 80 as well as a series of clearance holes 82 for receiving an adjustment mechanism 84 as shown in FIG. 10. The cap screws 86 pass through holes 88 in the profiling plate 4 are used to force the clamping bar 75 against an inner surface of the T-slot 68 as discussed above.

Figure 11:
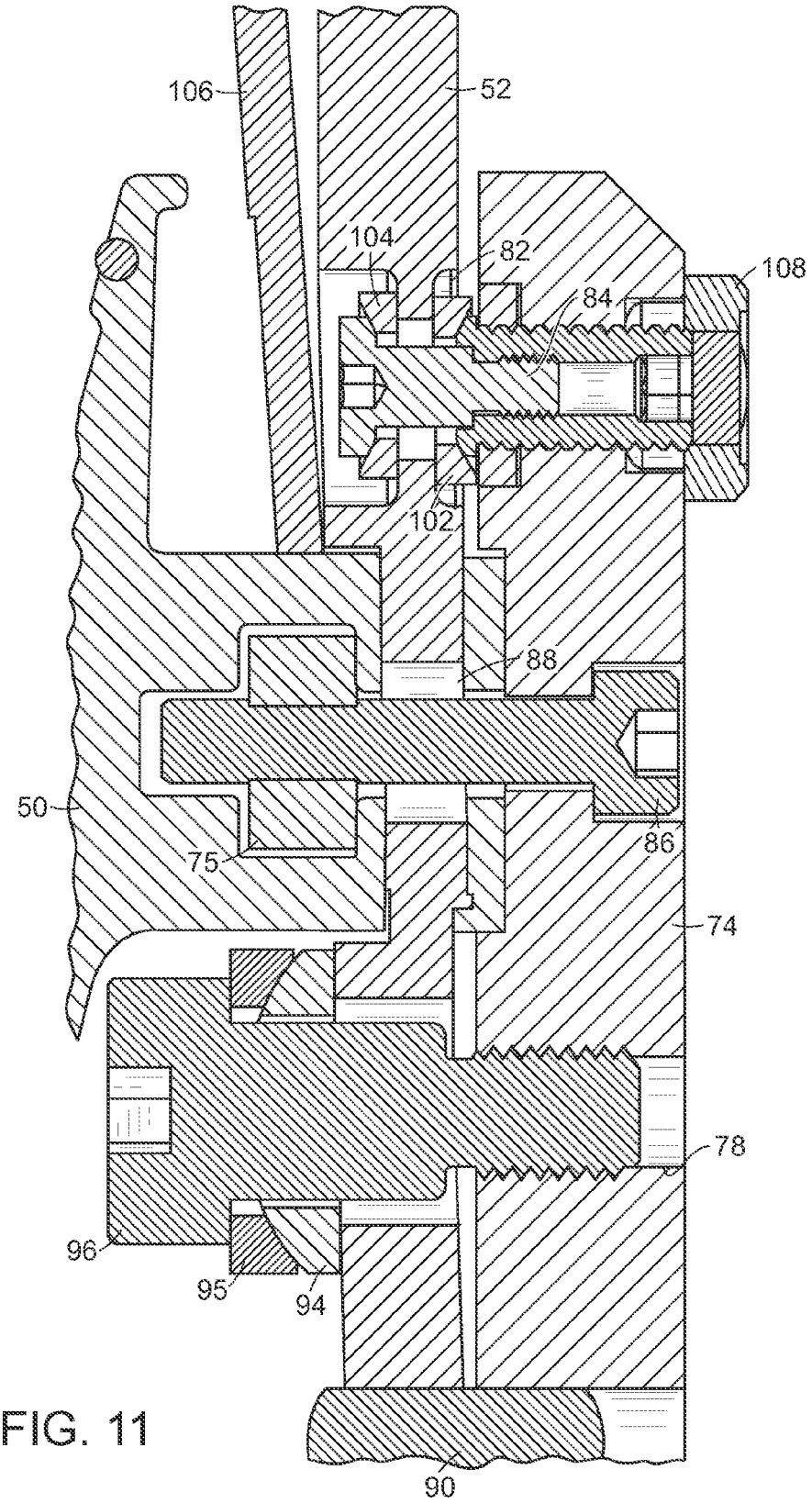
FIG. 11 shows an illustrative diagrammatic view of the doctor blade holder system of FIG. 7 wherein actuation of an adjustment mechanism has caused relative movement of a profiling plate mounting structure with respect to a holder mounting plate mounting structure.

The profiling plate 52 extends in the longitudinal direction and is attached along the bottom edge thereof to the holder mounting plate 74 with a different embodiment of an adjustment mechanism 84. Again, adjustment mechanisms 84 are provided along the longitudinal direction of the profiling plate 52 and the holder mounting plate 74 that permit the profiling plate 52 to be moved a small amount away from the holder mounting plate 74 in order to accommodate small variations in the distance between the tip of the doctor blade 56 and the roll surface. FIG. 11 shows the holder in cross-section with the profiling plate adjusted towards a Yankee (away from the holder mounting plate).

As also shown in FIGS. 8 and 11, the profiling plate 52 may include a series of mutually spaced pins 90 that are pressed into the holder mounting plate 74 to provide a primary support for the profiling plate 52 in the vertical direction.

The spherical mounting arrangements 92 of the present embodiment also allow for flexure, or localized rotation, of the profiling plate around one or two axes shown diagrammatically in FIG. 2. A longitudinal fulcrum or ridge 93 is machined into the profiling plate 52 to create a center of rotation. In accordance with an embodiment, the spherical mounting arrangement 92 may include a spherical thrust bearing having mounting structure elements 94 and 95, that cooperate to with a shoulder screw 96 to provide a small range of movement of the profiling plate 52 with respect to the holder mounting plate 74 responsive to movement of the adjustment mechanism 84. In particular, as the adjustment mechanism urges the profiling plate 52 toward the roll surface, the profiling plate mounting structure 94 moves with respect to the shoulder screw, while the holder mounting plate mounting structure 95 remains with the shoulder screw.

Again with reference to FIG. 11, during adjustment of the adjustment mechanism 84, the shoulder screw 96 and the concave portion 95 of the assembly remain fixed, while the convex portion 94 of the assembly move with the profiling plate to accommodate the pivoting motion of the profiling plate 4 caused by the movement of the profiling plate 4 with respect to the holder mounting plate 13 (which, again was caused by adjustment of the adjustment mechanism 29). In accordance with further embodiments of the invention, many other spherical mounting designs may be used to provide the required freedom of movement of the profiling plate 4 with respect to the holder mounting plate 13.

As discussed above, series of spaced, rectangular-shaped, openings 70 are machined in the profiling plate allowing the lands of the doctor blade support structure to pass through, and mate up to the holder mounting plate. The profiling plate 52 may be one continuous member or it may be segmented in order to increase flexibility or reduce manufacturing costs. If it is segmented, then an additional load-bridging member would be utilized. This load-bridging member would provide a connection between segments and would serve to align the facing ends of adjacent segments. Alternatively, a series of mutually spaced vertical cuts 98 may be provided in the profiling plate 52 to increase flexibility. The series of adjustment mechanisms 84 are threaded through the holder mounting plate 74 and act on the upper area of the profiling plate 52.

One embodiment of these adjustment mechanisms 84 consists of a rotatable, externally threaded body and a flanged screw 100 connection to the profiling plate. This mechanism is capable of accommodating the angular movement of the profiling plate 52. A preferred design has an inner removable flanged screws 100 that are attached to the main body of the adjustment mechanism 84 with a left-hand threaded connection. Again, by machining this connection with left-hand threads, the forces applied to the flange will serve to tighten the flange rather than loosen it when adjustments are made. Spherical washers 102, 104 mate with spherical surfaces machined on the flanged screw 100 and the adjustment mechanism 84 to allow for the angular movement of the profiling plate.

Again, these adjustment mechanisms may be set independently, within a range, to force the upper edge of the profiling plate, into or away from the back-up blade 106. The back-up blade, in turn, transfers this movement, and associated force, directly into the working blade. As discussed above, this feature allows precise control of the contact load between the working blade and the Yankee surface, continuously across the full width of the Yankee. Once each adjustment mechanism is set, a special cap 108, with female threads is screwed onto the adjustment mechanism 84 and tightened. Again, this action serves to lock the adjustment mechanism at the desired setting, while also preventing process contaminants from interfering with the threads or filling the wrench socket. An equalizer tube 110 may also be used as discussed above.

Those skilled in the art will appreciate that numerous modifications and variations may be made to the above disclosed embodiments without departing from the spirit and scope of the present invention.

What is claimed is:

1. A doctor blade holder system, comprising:

a. a doctor blade support structure that includes an elongated slot for receiving a doctor blade and a separate elongated slot to house mounting hardware;

b. an adjustable profiling plate that causes pressure to be applied to a back-up blade, that in turn causes pressure to be applied to the working blade in a continuous manner along the length of the working blade, wherein the profiling plate is mounted to a holder mounting plate with a series of pairs of mounting structures allowing unconstrained flexure of the profiling plate with respect to holder mounting plate; and c. a series of adjustment mechanisms attached to the holder mounting plate and acting on the profiling plate, wherein the adjustment mechanisms are capable of displacing the profiling plate in a bi-directional manner.

2. The doctor blade holder system of claim 1, wherein the doctor blade support structure is directly connected to the holder mounting plate of the doctor beam.

3. The doctor blade holder system of claim 1, wherein the doctor blade support structure is directly connected to the profiling plate.

4. The doctor blade holder system of claim 1, wherein the doctor blade support structure is segmented.

5. The doctor blade holder system of claim 4, wherein a load-bridging element extends from one segment to the next and serves to align the facing ends of adjacent segments.

6. The doctor blade holder system of claim 1, wherein the profiling plate is segmented.

7. The doctor blade holder system of claim 6, wherein a load-bridging element extends from one segment to the next and serves to align the facing ends of adjacent segments.

8. The doctor blade holder system of claim 1, wherein the doctor blade support structure includes one or more integrated wear bars extending along the length of the doctor blade support structure, and wherein the wear bars are positioned to contact the doctor blade during its' insertion, removal and during operation.

9. The doctor blade holder system of claim 1, wherein the doctor blade support structure is coated with a hard coating to minimize wear due to contact with the working blade.

10. The doctor blade holder system of claim 1, wherein the doctor blade support structure is coated with a release type coating to minimize the build-up of process contaminants.

11. The doctor blade holder system of claim 1, wherein the doctor blade support structure is fitted with a doctor blade cartridge.

12. The doctor blade holder system of claim 11, wherein the spacer elements internal to the doctor blade cartridge can be fixed at various heights to accommodate a range of working blade widths.

13. The doctor blade holder system of claim 11, wherein the doctor blade cartridge contains load sensing and/or vibration sensing elements capable of sensing the static and/or dynamic load transmitted through the doctor blade.

14. The doctor blade holder system of claim 1, wherein the doctor blade support structure consists of one or more extruded aluminum elements.

15. The doctor blade holder system of claim 1, wherein the doctor blade support structure consists of one or more fiber reinforced plastic composite elements.

16. The doctor blade holder system of claim 1, wherein the doctor blade support structure contains load sensing and/or vibration sensing devices capable of sensing the static and/or dynamic load transmitted through the doctor blade.

17. The doctor blade holder of claim 1, wherein the back-up blade is made from a metallic material.

18. The doctor blade holder system of claim 1, wherein the back-up blade is made from a composite material.

19. The doctor blade holder system of claim 1, wherein the thickness of the back-up blade is 0.025 inch to 0.250 inch.

20. The doctor blade holder system of claim 1, wherein an equalizing tube is included and acts on the back-up blade to minimize the contact load variation between the back-up blade and working blade along the full length of the working blade.

21. The doctor blade holder system of claim 20, wherein the equalizing tube is filled with a viscous liquid.

22. The doctor blade holder system of claim 20, wherein the equalizing tube is of a solid, resilient material such as an elastomer.

23. The doctor blade holder system of claim 1, wherein a full-length clamping bar is included and is located in the elongated mounting slot of the doctor blade support structure.

24. The doctor blade holder system of claim 1, wherein a segmented clamping bar is included and is located in the elongated mounting slot of the doctor blade support structure.

25. The doctor blade holder system of claim 1, wherein a cap with internal threads is attached to the adjustment mechanisms and tightened to hold the adjustment mechanisms in the desired position, and which prevents process contaminants from interfering with the adjustment mechanism.

26. The doctor blade holder system as claimed in claim 1, wherein each of the pairs of the series of pairs of mounting structures, includes mounting structure elements, each mounting structure element of each pair having a mutually complementary curved surface that is adapted to move with respect to the curved surface of the other mounting structure element of each pair.

27. The doctor blade holder system as claimed in claim 26, wherein one mounting structure element of each pair of mounting structures is fixed to the profiling plate.

28. The doctor blade holder system as claimed in claim 1, wherein the profiling plate include one of a longitudinal fulcrum or ridge.

29. A doctor blade holder system, comprising:

a. a doctor blade support structure that includes an elongated slot for receiving a doctor blade and a separate elongated slot to house mounting hardware for attaching the doctor blade support structure to a holder mounting plate;

b. a plurality of adjustment mechanisms attached to the holder mounting plate and acting on a profiling plate; where the adjustment mechanisms are capable of displacing the profiling plate relative to the holder mounting plate and wherein the profiling plate acts on a back-up blade to transfer force to the doctor blade; and c. a plurality of movable attachment mechanisms for attaching the doctor blade support structure to the holder mounting plate yet permit the profiling plate to move with respect to the holder mounting plate.

* * * * *